US010755519B2

(12) United States Patent
Phillips, Jr. et al.

(10) Patent No.: US 10,755,519 B2
(45) Date of Patent: Aug. 25, 2020

(54) GAMING MACHINE WITH DUAL TRANSLATION FRONT ACCESS STRUCTURE

(71) Applicant: Everi Games, Inc., Austin, TX (US)

(72) Inventors: Peter A. Phillips, Jr., Austin, TX (US); Craig Steven Gallagher, Austin, TX (US); Travis B. Bussey, Austin, TX (US)

(73) Assignee: Everi Games, Inc., Austin, TX (US)

( * ) Notice: Subject to any disclaimer, the term of this patent is extended or adjusted under 35 U.S.C. 154(b) by 0 days.

(21) Appl. No.: 16/449,190

(22) Filed: Jun. 21, 2019

(65) Prior Publication Data

US 2020/0111285 A1 Apr. 9, 2020

Related U.S. Application Data

(60) Provisional application No. 62/742,443, filed on Oct. 7, 2018.

(51) Int. Cl.
*G07F 17/32* (2006.01)

(52) U.S. Cl.
CPC ..... *G07F 17/3216* (2013.01); *G07F 17/3211* (2013.01)

(58) Field of Classification Search
None
See application file for complete search history.

(56) References Cited

U.S. PATENT DOCUMENTS

| | | | | |
|---|---|---|---|---|
| 6,231,446 | B1 * | 5/2001 | Majima | G07F 17/3216 463/46 |
| 2007/0111776 | A1 * | 5/2007 | Griswold | G07F 17/32 463/16 |
| 2016/0343204 | A1 * | 11/2016 | Maher | E05F 3/02 |
| 2019/0080553 | A1 * | 3/2019 | Hohman | G07F 17/3216 |
| 2019/0102983 | A1 | 4/2019 | Gallagher | |
| 2019/0102984 | A1 | 4/2019 | Gallagher | |

* cited by examiner

*Primary Examiner* — Jason T Yen
(74) *Attorney, Agent, or Firm* — The Culbertson Group, P.C.; Russell D. Culbertson

(57) ABSTRACT

A gaming machine includes a cabinet defining a cabinet volume with a front access opening. A display assembly having one or more display devices is mounted on the gaming machine cabinet through a translation frame and a display assembly translation structure. The translation frame is mounted in the cabinet so as to be moveable relative to the cabinet between a frame home position and a frame raised position. The display assembly translation structure connects the display assembly to the translation frame, and is operable to move between a retracted position in which the display assembly registers with part of the cabinet access opening and an extended position in which the display assembly is separated forwardly from the front access opening by at least a cabinet access distance.

17 Claims, 9 Drawing Sheets

GAMING MACHINE WITH DUAL TRANSLATION FRONT ACCESS STRUCTURE

CROSS-REFERENCE TO RELATED APPLICATION

This application claims the benefit, under 35 U.S.C. § 119(e), of U.S. Provisional Patent Application No. 62/742,443 filed Oct. 7, 2018 and entitled "Gaming Machine with Dual Translation Front Access Structure." The entire content of this provisional application is incorporated herein by this reference.

TECHNICAL FIELD OF THE INVENTION

The invention relates to gaming machine cabinets and particularly to access structures associated with such cabinets. The invention encompasses a gaming machine and methods for providing access to the interior of a gaming machine.

BACKGROUND OF THE INVENTION

Gaming machines found in casinos and other gaming establishments commonly include a cabinet on which various display devices and player interface devices are mounted. The display devices may include one or more video display monitors which are operable to display game-related information and other information and to display games conducted at the gaming machine such as video reel-type games, video card games, and other types of wagering games. Player interface devices may include ticket or voucher printers, various control buttons, cash-in or ticket-in devices, and player card readers. Gaming machine cabinets define an interior volume for housing various internal components such as data processing devices and supporting equipment. While the interior components of the gaming machine must remain secured so as to prevent unauthorized access and tampering with the gaming machine, it is still necessary for the gaming machine cabinets to have access points to allow authorized personnel to access the interior volume of the cabinet for maintenance and repair purposes.

Providing access to the interior volume of a gaming machine cabinet can be problematic for a number of reasons. One issue arises from the fact that gaming machines are commonly arranged on the casino floor close together side-by-side and either back-to-back with other gaming machines or against a wall. This leaves the front of the gaming machine cabinet as the only exposed portion for providing access to the interior volume when the gaming machine remains in place on the casino floor. Yet in in modern gaming machines, video display monitors and other electronic devices take up a substantial portion of the front surface of the gaming machine, if not the entire front surface, leaving little or no room for access without moving the video display monitors and other electronic equipment from their operating positions on the gaming machine cabinet. Moving the video display monitors from their operating position can cause problems where such devices must remain supported by the gaming machine cabinet because repositioning the devices can leave the gaming machine in danger of tipping over.

SUMMARY OF THE INVENTION

It is an object of the invention to provide gaming machines having a cabinet access structure that provides superior access to the interior volume of the cabinet while the gaming machine may remain installed in a bank of gaming machines or other arrangement in a casino or other gaming establishment. Although not limited to such applications, aspects of the present invention are particularly applicable to gaming machines having large display devices such as video display monitors for displaying wagering games and information to players.

A gaming machine according to one aspect of the present invention includes a cabinet defining a cabinet volume with a front access opening defining a front boundary of the cabinet volume. A gaming machine according to this aspect of the invention also includes a display assembly having one or more display devices for the gaming machine. The display assembly is mounted on the gaming machine cabinet through a translation frame and a display assembly translation structure. The translation frame is located within the cabinet volume and is mounted in the cabinet so as to be moveable relative to the cabinet between a frame home position and a frame raised position. The display assembly translation structure connects the display assembly to the translation frame, and is operable to move between a retracted position and an extended position. When the display assembly translation structure is in the retracted position, the display assembly registers with at least a first part of the front access opening. However, when the display assembly translation structure is in the extended position, the display assembly is separated forwardly from the front access opening by at least a cabinet access distance.

Another aspect of the invention includes methods of providing access to a cabinet volume of a gaming machine cabinet where the gaming machine cabinet includes a front access opening defining a front boundary of the cabinet volume. Methods according to this second aspect of the invention include supporting the translation frame within the cabinet, supporting the display assembly translation structure on the translation frame, and supporting the display assembly on the display assembly translation structure. In particular, the translation frame is supported in the cabinet volume so as to be movable relative to the gaming machine cabinet vertically between the frame home position and the frame raised position, and the display assembly translation structure is movable between the retracted position and the extended position. According to this second aspect of the invention, when the translation frame is in the frame home position and the display assembly translation structure is in the retracted position, the display assembly registers with a first part of the front access opening. However, when the translation frame is in the frame raised position and the display assembly translation structure is in the retracted position, the display assembly registers with less than the first part of the front access opening. Also, when the display assembly translation structure is in the extended position the display assembly is separated forwardly from the front access opening by at least the cabinet access distance.

As used in this disclosure and the accompanying claims, that a given element "registers" with a given opening means that surfaces of that element align with and lie in close proximity to surfaces defining the opening so as to substantially cover the opening. This close proximity need not be such as to form a fluid-tight seal between the surfaces of the given element and the surface defining the opening, but is sufficient to prevent the passage of tools normally used to service a gaming machine cabinet or the passage of human digits or hands. Such close proximity may be no more than one-eighth to one-quarter inch in most cases. Also as used herein, an "access distance" such as the "cabinet access distance" by which the display assembly is separated from the front access opening when the display assembly translation structure is in the extended position comprises a distance that facilitates human hands or tools normally used to service a gaming machine to pass the separation to reach the cabinet volume. Such and access distance may be not less that two to six inches and preferably more than three inches.

The combination of the movement available from the translation frame together with the movement available through the display assembly translation structure according to the invention provide the ability to move the display assembly from the front access opening in two different ways to allow access to the cabinet interior volume for maintenance or repairs. Additionally, this access is possible from the front of the gaming machine so that the gaming machine may remain in its operating position on the casino floor during maintenance. Furthermore, the translation frame and display assembly translation structure according to aspects of the invention continue to support the display assembly on the gaming machine cabinet so that repair or maintenance operations may be performed without having to separately support the display assembly. Furthermore, the movement of the display assembly according to these aspects of the invention may be limited so that the gaming machine does not become undesirably unbalanced when the front access opening is exposed for repair or maintenance operations.

In some implementations according to either of the foregoing aspects of the invention, the translation frame moves along a frame translation axis when moved between the frame home position and the frame raised position. This frame translation axis and a longitudinal axis of the translation frame may both extend substantially vertically when the gaming machine is in the operating position. The vertical movement of the display arrangement in these implementations facilitates access to the cabinet volume through at least a lower part of the front access opening without shifting the center of balance of the gaming machine either forward or rearward.

In some implementations according to either of the above-described aspects of the invention, the translation frame is movable between the frame home and frame raised positions with the display assembly translation structure in either the extended or retracted position. Other implementations may limit the movement of the display assembly translation structure between its extended and retracted positions to only when the translation frame is in the frame raised position or only when the translation frame is in the frame home position. In either case, the translation frame may be supported for movement within the cabinet volume on a system of rails and carriage assemblies. For example, side rails may be mounted on both lateral sides of the gaming machine cabinet within the cabinet volume. A respective carriage assembly may be supported on each rail so as to be slidable along the respective rail, and the translation frame may be connected on either lateral side to the carriage assemblies. This allows the translation frame to move along the rails on the carriage assemblies. Suitable biasing devices may be included for each carriage assembly to bias the respective carriage assembly upwardly to counter the weight of the translation frame and components mounted on that frame.

In implementations according to either of the foregoing aspects of the invention, a top boundary of the cabinet volume may be defined by a top opening which may be covered by a top enclosure. The top enclosure in these implementations may be mounted on the translation frame so that when the translation frame is in the frame home position the top enclosure registers with and covers the cabinet top opening. Moving the translation frame to the frame raised position removes the top enclosure to expose the cabinet top opening. This arrangement of translation frame-mounted top enclosure allows greater range of movement of the translation frame.

Some implementations of the present invention may facilitate only the movement of the display assembly of the gaming machine. Other implementations may facilitate the movement of other parts of the gaming machine which register with parts of the front access opening when the gaming machine is in use. For example, a component panel may also be mounted on the translation frame. This component panel may register with a lower portion of the front access opening when the translation frame is in its frame home position. Raising the translation frame to its frame raised position also raises the component panel, preferably at least a panel area access distance from a lower boundary of the front access opening. This movement of the component panel exposes at least part of the front access opening to allow access to the cabinet volume for maintenance or repair operations.

These and other advantages and features of the invention will be apparent from the following description of representative embodiments, considered along with the accompanying drawings.

DESCRIPTION OF REPRESENTATIVE EMBODIMENTS

Figure 1:
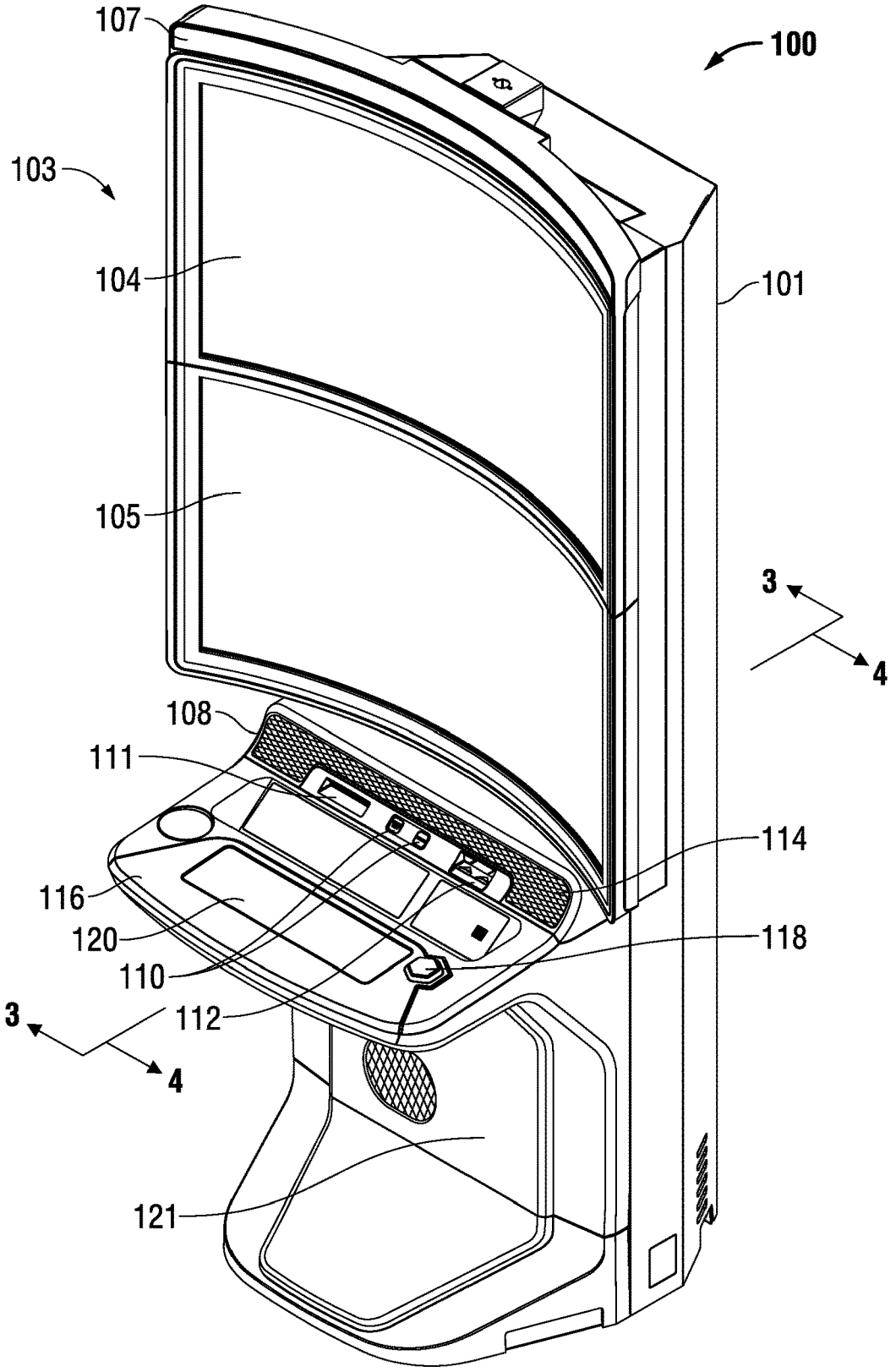
FIG. 1 is a front right perspective view of a gaming machine embodying principles of the invention.

As used in this disclosure and the accompanying claims, relative positional terms such as upper, lower, top, bottom, front, back, and forward for example, are defined with reference to the orientation of the example gaming machine shown in the above-described drawings. These drawings show the gaming machine in an operating position standing upright with a top end of the gaming machine generally at the top of the drawing sheet and a bottom end of the gaming machine at the bottom of the drawing sheet.

Referring to FIG. 1, an example gaming machine 100 includes a gaming machine cabinet 101 on which is mounted a display assembly shown generally at reference numeral 103. Video display assembly 103 in this particular gaming machine includes two separate video display monitors, a first display monitor 104 and a second display monitor 105. A sound bar speaker system 107 is also included in the display assembly 103 in example gaming machine 100. Gaming machine 100 further includes a component panel 108 containing player controls 110 and containing or providing access to several player interface devices as indicated by ramps 111 and 112. A second sound bar speaker assembly is also included on component panel 108 as indicated by speaker grille 114. A player control deck 116 is also included on gaming machine cabinet 101 protruding from a front of the cabinet immediately below component panel 108. Various player interface devices such as a physical button 118 and touchscreen control panel 120 are located on the illustrated button deck 116. One or more removable or openable panels 121 may be positioned at the front of the gaming machine cabinet below player control deck 116.

Figure 2:
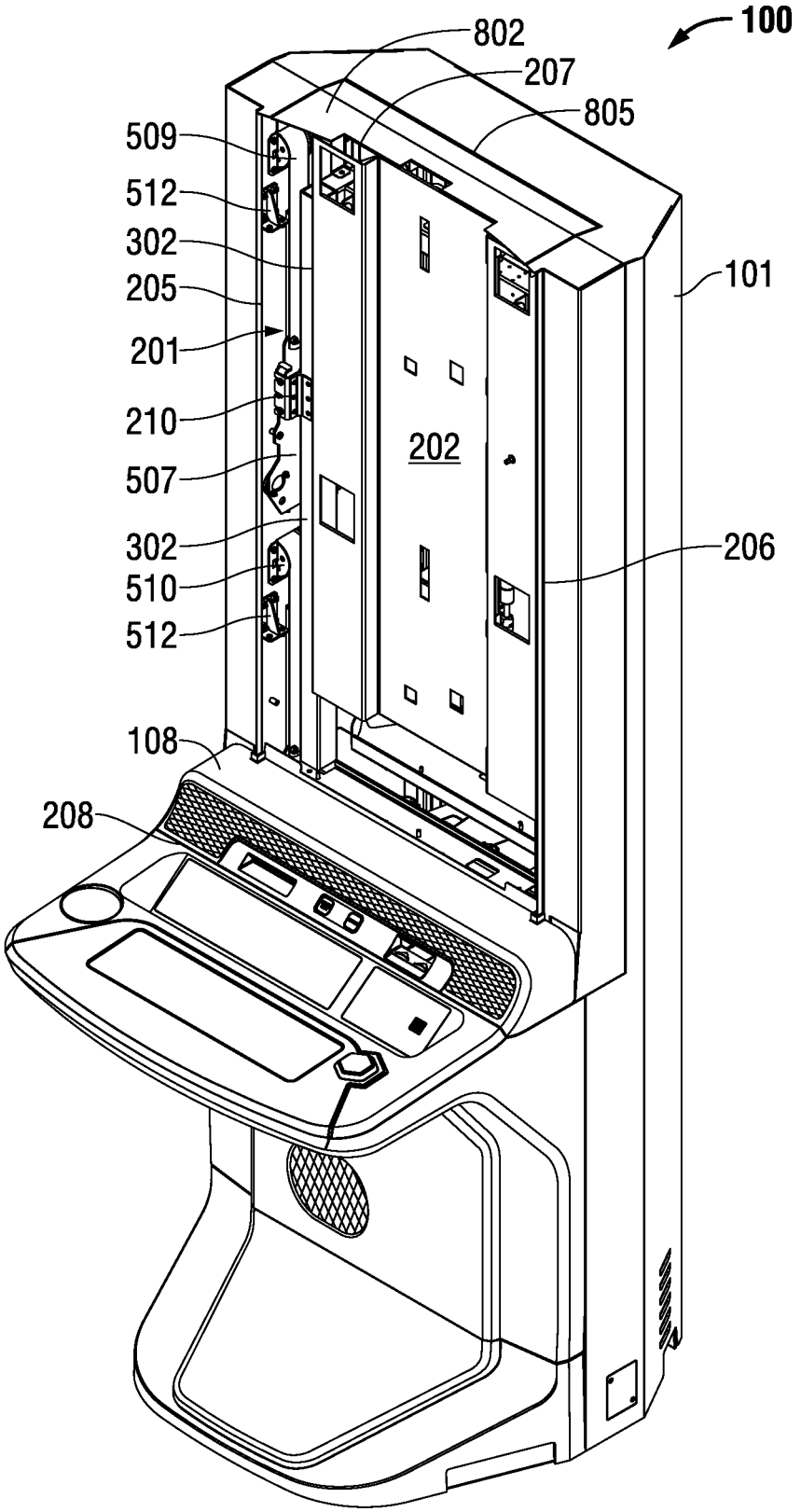
FIG. 2 is a front right perspective view similar to FIG. 1 but with a display assembly removed from the gaming machine to expose a portion of the front access opening of the gaming machine.

FIG. 2 shows gaming machine 100 with the displays 104 and 105, and the sound bar 107 (all shown in FIG. 1) removed, leaving an upper portion of the cabinet volume shown by arrow 201 exposed. This cabinet volume 201 is also shown in the views of FIGS. 3-9. Also exposed in FIG. 2 is a display mounting bracket 202 and various components which cooperate to allow the movement of display assembly 103 (in FIG. 1) to a position in which the cabinet volume 201 may be accessed by appropriate personnel for maintenance or repair. These components will be introduced and described below. As best shown in the perspective view of FIG. 2, cabinet volume 201 is bounded in front by a front access opening which comprises an opening defined by parts of the cabinet 101. In particular, the front access opening is defined laterally by a left side edge 205, a right side edge 206, a top edge 207, and a bottom edge 208. In the view of FIG. 2, component panel 108 remains in its operating position on the gaming machine, and in this operating position registers with a lower part of the front access opening so as to cover that lower part of the front access opening. This lower part of the front access opening will be described further below in connection with FIG. 8 and the movement of component panel 108 from its operating position according to this particular embodiment of the invention.

The present invention includes structures and methods for allowing the displays of a gaming machine, such as displays 104 and 105, to be temporarily moved from the operating position such as that shown in FIG. 1 so that authorized personnel may access the cabinet volume 201 through the front access opening for maintenance, repair, or other operations. The structures and methods according to the invention facilitate the temporary movement of the displays while still supporting the displays by the gaming machine cabinet 101. The particular embodiment illustrated in the figures also allows component panel 108 to be temporarily moved from its operating position to allow access to the interior volume of the cabinet 101 through the front access opening. As with the displays 104 and 105, the component panel 108 remains supported by the gaming machine cabinet 101 at all times so that authorized personnel may obtain access to the interior cabinet volume without having to hold the component panel in the displaced position.

Figure 3:
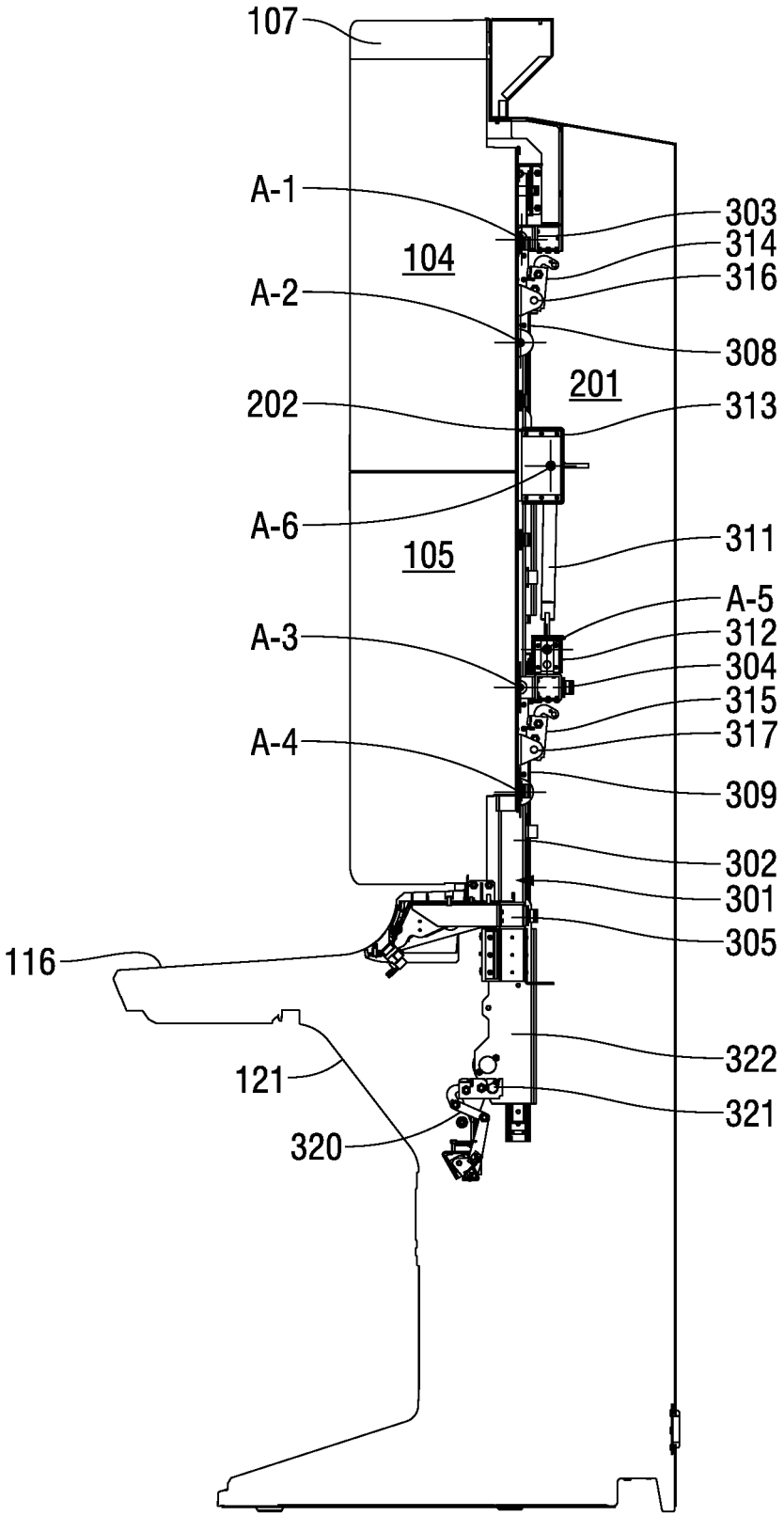
FIG. 3 is a section view taken along line 3-3 in FIG. 1.
Figure 4:
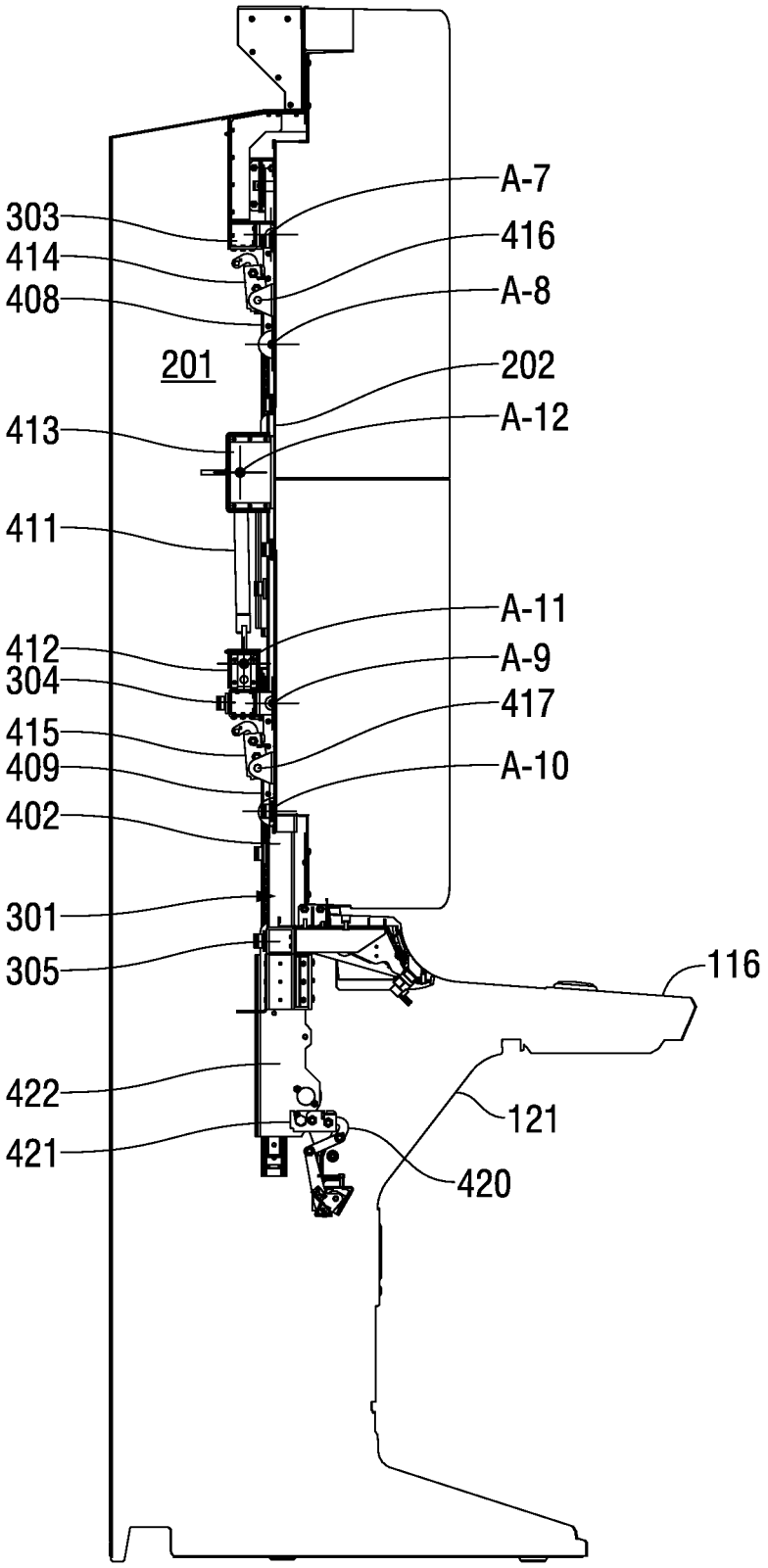
FIG. 4 is a section view taken along line 4-4 in FIG. 1.
Figure 5:
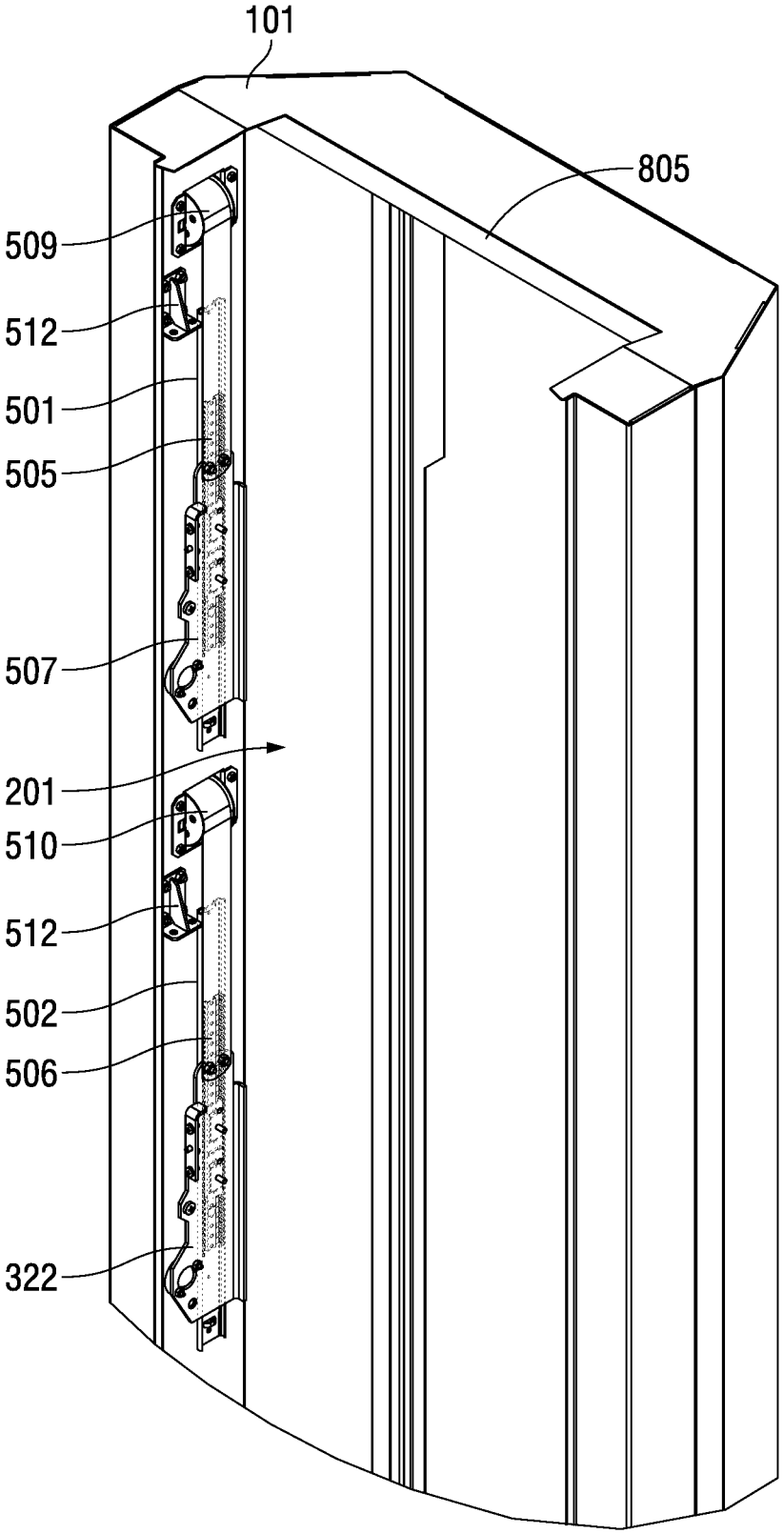
FIG. 5 is a front right perspective view of an upper portion of the gaming machine cabinet shown in FIG. 1, but with the display assembly, translation frame, and display assembly translation structure removed to show the mounting structure for the translation frame along a left lateral side of the cabinet volume.
Figure 6:
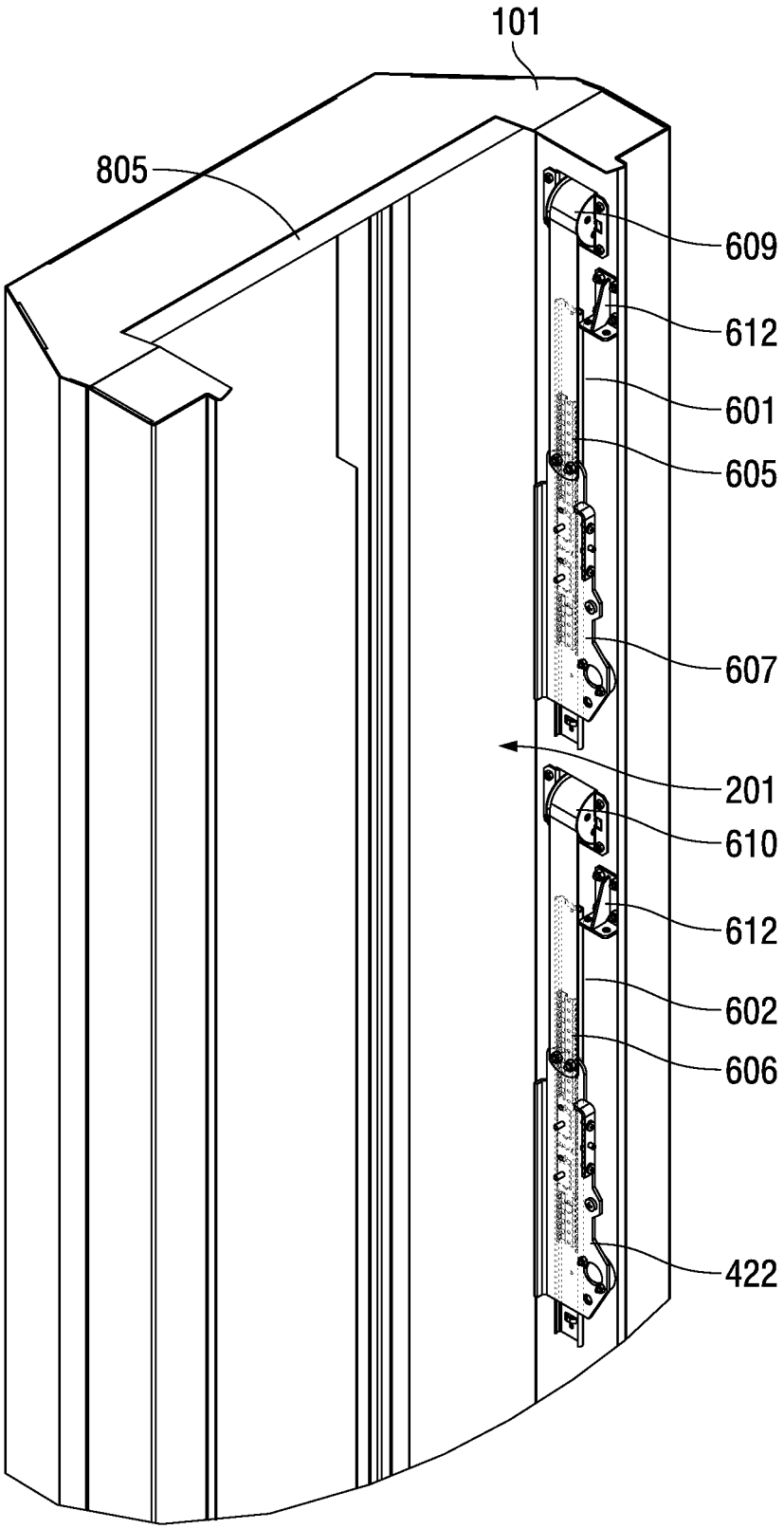
FIG. 6 is a front left perspective view of the upper portion of the gaming machine cabinet shown in FIG. 1, but with the display assembly, translation frame, and display assembly translation structure removed to show the mounting structure for the translation frame along a right lateral side of the cabinet volume.

The views of FIGS. 3-6 may be used to describe various components for facilitating the movement of the display devices 104 and 105 and component panel 108 as described above. Many of the components of the apparatus either span the width of cabinet volume 201 or are spaced apart on opposite sides of the cabinet volume. Thus one transverse section view can only show components on one side of the cabinet volume. In the following, the view of FIG. 3 may be referenced for components on the left side of cabinet volume 201 while the view of FIG. 4 may be referenced in connection with components mounted on the right side of cabinet volume 201. Similarly, FIG. 5 shows additional components on the left side of cabinet volume 201 which are mostly obscured in FIG. 3 and FIG. 6 shows components on the right side of cabinet volume 201 which are mostly obscured in the section view of FIG. 4. It will be noted that all of the section views are simplified so as to show certain components such as the displays 104 and 105 in generally schematic form and generally only an outline is provided for portions of the gaming machine cabinet 101 so that the details of those elements and other structure in the gaming machine cabinet does not obscure the components of the various structures according to the present invention.

Referring to FIG. 3, the displays 104 and 105 are shown in their operating position mounted on the display mounting bracket 202. FIG. 3 also shows that the gaming machine 100 includes a translation frame shown generally at reference number 301 mounted within cabinet volume 201. The view of FIG. 3 shows only portions of a left side member 302, top crossmember 303, middle crossmember 304, and bottom crossmember 305 of the translation frame. Crossmembers 303, 304, and 305 are all shown in section since those crossmembers all extend perpendicular to, and traverse the section plane for the view of FIG. 3. FIG. 4 shows a right side member 402 of the translation frame along with the top, middle, and bottom crossmembers 303, 304, and 305, respectively, which connect the two frame members 302 and 402. Each crossmember 303, 304, and 305 as well as each of the side frame members 302 and 402 preferably comprise square tubes of suitable material, welded or otherwise joined together to form translation frame 301.

FIGS. 3 and 4 also show that display mounting bracket 202 is connected to translation frame 301 via a number of pivoting arms, which, together with the bracket 202 form a display assembly translation structure. FIG. 3 shows the left side components of the display assembly translation structure including a left upper arm 308 and left lower arm 309. Although much of left upper arm 308 is obscured by other components in the view of FIG. 3, a proximal end of the left upper arm is connected to the translation frame 301 so as to be rotatable about an axis A-1 and the opposite end of the left upper arm is connected the back of the display mounting bracket 202 and is rotatable about an axis A-2. Similarly left lower arm 309 has a proximal end connected to translation frame 301 so as to be rotatable about an axis A-3 and the opposite end is connected to the back of the display mounting bracket 202 so as to be rotatable about and axis A-4. All the left upper and left lower arm connections are configured so that the axes A-1, A-2, A-3, and A-4 all extend substantially perpendicular to the plane of the drawing sheet. FIG. 3 also shows a left side damper 311 connected between display mounting bracket 202 and the translation frame 301. In particular a proximal end of left side damper 311 connected to a bracket 312 mounted on translation frame 301 so as to be rotatable about axis A-5, while the opposite end of left side damper 311 is connected to a damper bracket 313 at the back of display mounting bracket 202 so as to be rotatable about an axis A-6.

FIG. 4 shows the corresponding right side components of the display assembly translation structure. In particular FIG. 4 shows a right side upper arm 408 connected at a proximal end to translation frame 301 so as to be rotatable about an axis A-7 and connected at the opposite end at the back of display mounting bracket 202 so as to be rotatable about an axis A-8. A right side lower arm 409 is connected a proximal end to translation frame 301 so as to be rotatable about an axis A-9 and connected at the opposite end at the back of display mounting bracket 202 so as to be rotatable about an axis A-10. A right side damper 411 is also similarly connected to translation frame 301 at a bracket 412 and to display mounting bracket 202 via bracket 413, rotatable about an axis A-11 at the translation frame and about an axis A-12 at the back of display mounting bracket 202.

A latching arrangement is included in the illustrated embodiment to secure the display assembly in the retracted, operating position shown in FIGS. 3 and 4. FIG. 3 shows an upper left side latch 314 and a lower left side latch 315, both connected by suitable means (such as a suitable bracket, not shown) to translation frame 301. Upper left side latch 314 is adapted to receive a latching bar 316 mounted at the back of display mounting bracket 202. Lower left side latch 315 is adapted to receive a latching bar 317 also mounted at the back of display mounting bracket 202. FIG. 4 shows a similar latching arrangement on the right side of the assembly. In particular FIG. 4 shows a translation frame-mounted upper right side latch 414 adapted to receive a latching bar 416 on display mounting bracket 202 and also shows a lower right side latch 415 connected to translation frame 301 and adapted to receive a latching bar 417 mounted on the display mounting bracket. In the preferred implementations, each latching bar 316, 317, 416, and 417 is connected between two spaced apart tabs extending from the back of display mounting bracket 202 in order to securely hold the respective latching bar in position to be caught and retained by the respective latch mechanism.

As will be described further below, translation frame 301 is also mounted within the gaming machine so as to be movable from the frame home position shown in FIGS. 3 and 4 to a frame raised position shown in FIGS. 8 and 9. Because translation frame 301 is movable, the illustrated implementation also includes a latching arrangement which is adapted to latch the transition frame in the frame home position shown in FIGS. 3 and 4. Referring to FIG. 3, this latching mechanism includes a left side frame latch 320 mounted in a suitable fashion in a lower part of the cabinet volume 201. This left side frame latch 320 is adapted to catch a frame latching bar 321 mounted on a lower left side carriage 322 which is visible in FIG. 3 and will be described further below in connection with FIG. 5. FIG. 4 shows a corresponding latching structure on the right side of the assembly including a right side frame latch 420 which is adapted to catch a bar 421 mounted on a lower right side carriage 422 described below in connection with FIG. 6. All of the latches 314, 315, 414, 415, 320, and 420 are preferably operable via suitable controls which are accessible through the removable panel 121 in the lower part of the cabinet shown in the figures. Also, as will be described further below, the latches for the display assembly translation structure are operable separately from the latches for the translation frame. It should also be appreciated that the latches 314, 315, 414, 415, 320, and 420 are all shown without any supporting structure in order to simplify the drawings. Each of these latches are supported in the gaming machine by suitable supporting structure. For example, the translation frame-mounted latchets 314, 315, 414, and 415 may be supported on the translation frame by suitable brackets connected to the translation frame. Similarly, the latches 320 and 420 may be supported in cabinet volume 201 on suitable brackets connected to the gaming machine internal structure.

The components of the illustrated embodiment which allow translation frame 301 to move from its frame home position shown in FIGS. 3 and 4 are largely obscured by other components in FIGS. 3 and 4, and are best shown in the perspective views of FIGS. 5 and 6. In both of FIGS. 5 and 6, the display assembly (103 in FIG. 1), display mounting bracket (202 in FIGS. 2-4), and the translation frame (301 in FIGS. 3 and 4) and its associated components are all omitted so that the components allowing the translation frame 301 to move within cabinet 101 are visible. FIG. 5 shows the left side components of that structure while FIG. 6 shows the right side components of that structure.

Referring to FIG. 5, the illustrated gaming machine includes an upper left side rail 501 and a lower left side rail 502 both of which are mounted on an inside wall of cabinet 101. An upper left side slide member 505 is mounted on the upper left side rail 501 so as to be slidable along the longitudinal axis of the upper left side rail. Similarly, a lower left side slide member 506 is mounted on the lower left side rail 502 so as to be slidable along the longitudinal axis of that rail. An upper left side carriage 507 is mounted on upper left side slide element 505 so as to be slidable along the rail 501 along with that slide element. Lower left side carriage 322 (discussed above in connection with FIG. 3) is mounted on the lower left side slide element 506. The illustrated embodiment also includes a biasing arrangement for both the left side carriages 507 and 322. In particular an upper left side spring 509 is connected to the upper left side carriage 507 while a lower left side spring 510 is connected to lower left side carriage 322. These spring devices may comprise constant force springs for example and are operable to bias the carriages and the translation frame which is connected to the carriages upwardly to compensate for the weight of the translation frame and components mounted on the translation frame. Stops 512 are provided for each carriage 507 and 322 to limit their upward movement in cabinet 101.

FIG. 6 shows the right side structure corresponding to that shown in FIG. 5. In particular, FIG. 6 shows an upper right side rail 601 secured to an inside wall of the cabinet 101 and a lower right side rail 602 also secured to an inside wall of the cabinet. An upper right side slide element 605 is mounted on the upper right side rail 601 and slidable along the longitudinal axis of that rail. A lower right side slide element 606 is mounted on the lower right side rail 602 and similarly slidable along a longitudinal axis of that rail. An upper right side carriage 607 is mounted on the upper right side slide element 605 while the lower carriage 422 (described earlier in connection with FIG. 4) is mounted on the lower right side slide element 606. Similar to the structure shown in FIG. 5, an upper right side spring 609 is mounted on a wall of cabinet 101 and connected to upper right side carriage 607 while a lower right side spring 610 is connected to bias the lower right side carriage 422. Stops 612 are also included on the inner wall of cabinet 101 to limit the upward movement of the right side carriages 607 and 422.

It will be appreciated that the translation frame is rigidly connected to the two left side carriages 507 and 322 and the two right side carriages 607 and 422 in the illustrated embodiment to allow the translation frame to move along a translation axis as will be described further below. Any suitable arrangement may be used to connect the translation frame to the different carriages. In the illustrated embodiment, FIG. 2 shows a connection bracket 210 between upper left side carriage 507 and left side member 302 of the translation frame. Similar connecting brackets may be used to connect each other carriage to the translation frame.

Figure 7:
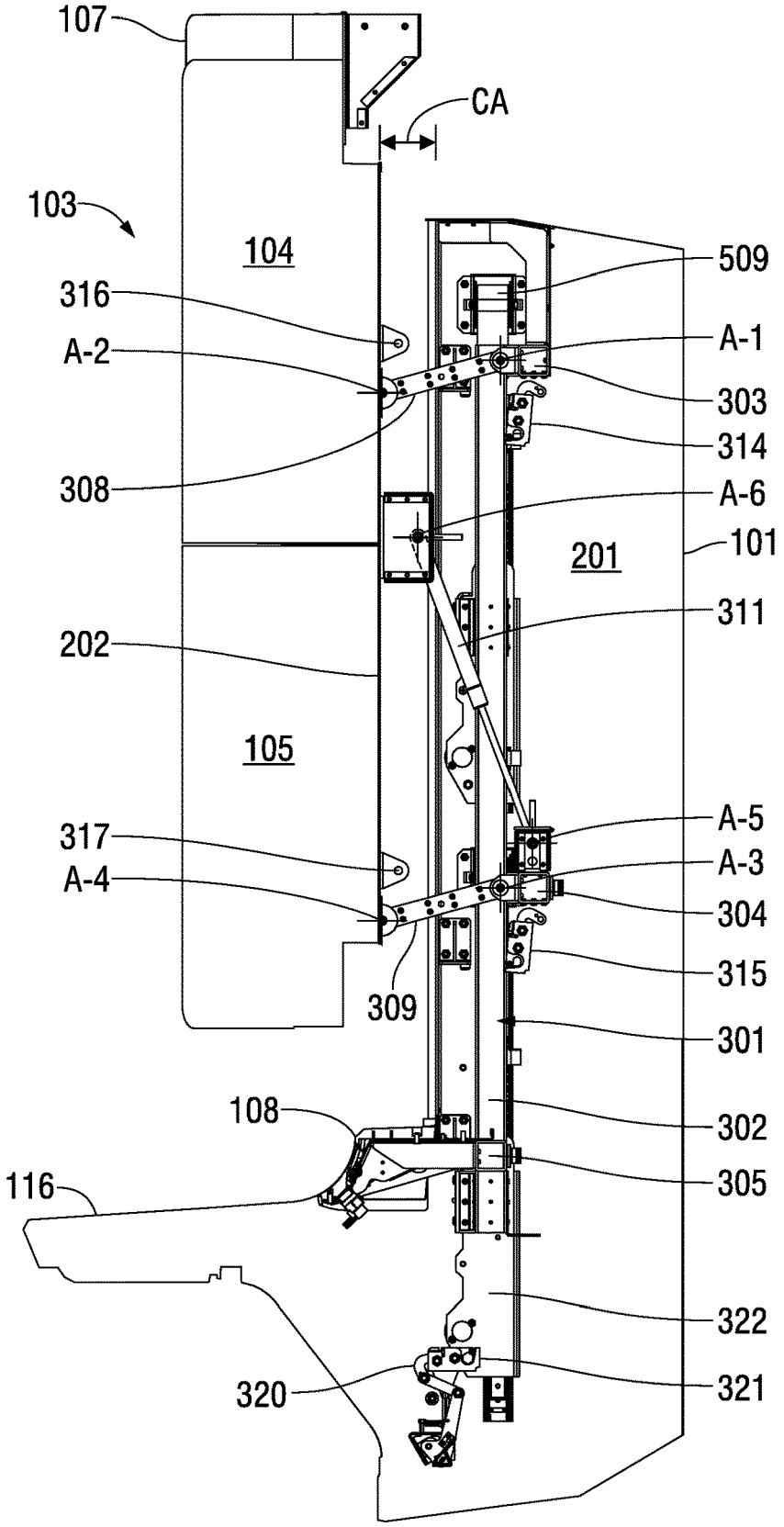
FIG. 7 is a section view of an upper portion of the gaming machine cabinet similar to FIG. 3, but with the display assembly translation structure moved from the retracted position shown in FIG. 3 to the extended position.

The operation of the illustrated display assembly translation structure may be described with reference particularly to FIG. 7, while the movement of the translation frame according to this particular form of the invention may be described with reference to FIG. 8. Referring first to FIG. 7, the upper and lower display device assembly latches 314 and 315, respectively, may be released by a suitable releasing control (not shown) to release the respective latching bars 316 and 317 on the left side of the assembly. Although not visible in the section of FIG. 7, it will be appreciated that the right side latches 414 and 415 (FIG. 4) must also be released to release the right side latching bars 416 and 417 (FIG. 4). When all of the latches associated with the display assembly translation structure are operated to release all of the corresponding latching bars at the back of display mounting bracket 202, an operator may lift the display assembly 103 upwardly from the latched position shown in FIGS. 3 and 4. In response to this upward force, the left side upper and lower arms 308 and 309 of the display assembly translation structure both rotate clockwise about their proximal end connection to the translation frame 301 ultimately to the extended position shown in FIG. 7. Damper 311 also extends as arms 308 and 309 rotated to the position shown in FIG. 7. It will be appreciated that in this particular embodiment with both left and right side arms, the right side arms not shown in FIG. 7, but visible in FIG. 4, also rotate about their proximal connection to translation frame 301. Similarly, damper 411 shown in FIG. 4 would also extend. Dampers 311 and 411 provide a damping force to help hold the display assembly 103 in the position shown in FIG. 7. In the extended state shown in FIG. 7, the displays 104 and 105 and display mounting bracket 202 are moved upwardly and separated from the edges of the gaming machine defining the front access opening. In the view of FIG. 7, the displays 104 and 105 and display mounting bracket 202 are separated from the front access opening by a cabinet access distance indicated at CA. It will be appreciated from FIG. 7 that while the displays 104 and 105 and display mounting bracket 202 are moved upwardly on the display assembly translation structure to the extended position, the translation frame 301 remains in its frame home position shown also in FIGS. 3 and 4. In particular the frame latch arrangement including left side latch 320 remains latched to bar 321 to hold the carriage 322 and thus translation frame 301 in their lowermost position within cabinet 101. The right side latch frame latch 420 described above in connection with FIG. 4 would also remain in the latched position retaining the lower right side carriage 422 in its lowermost position.

Figure 8:
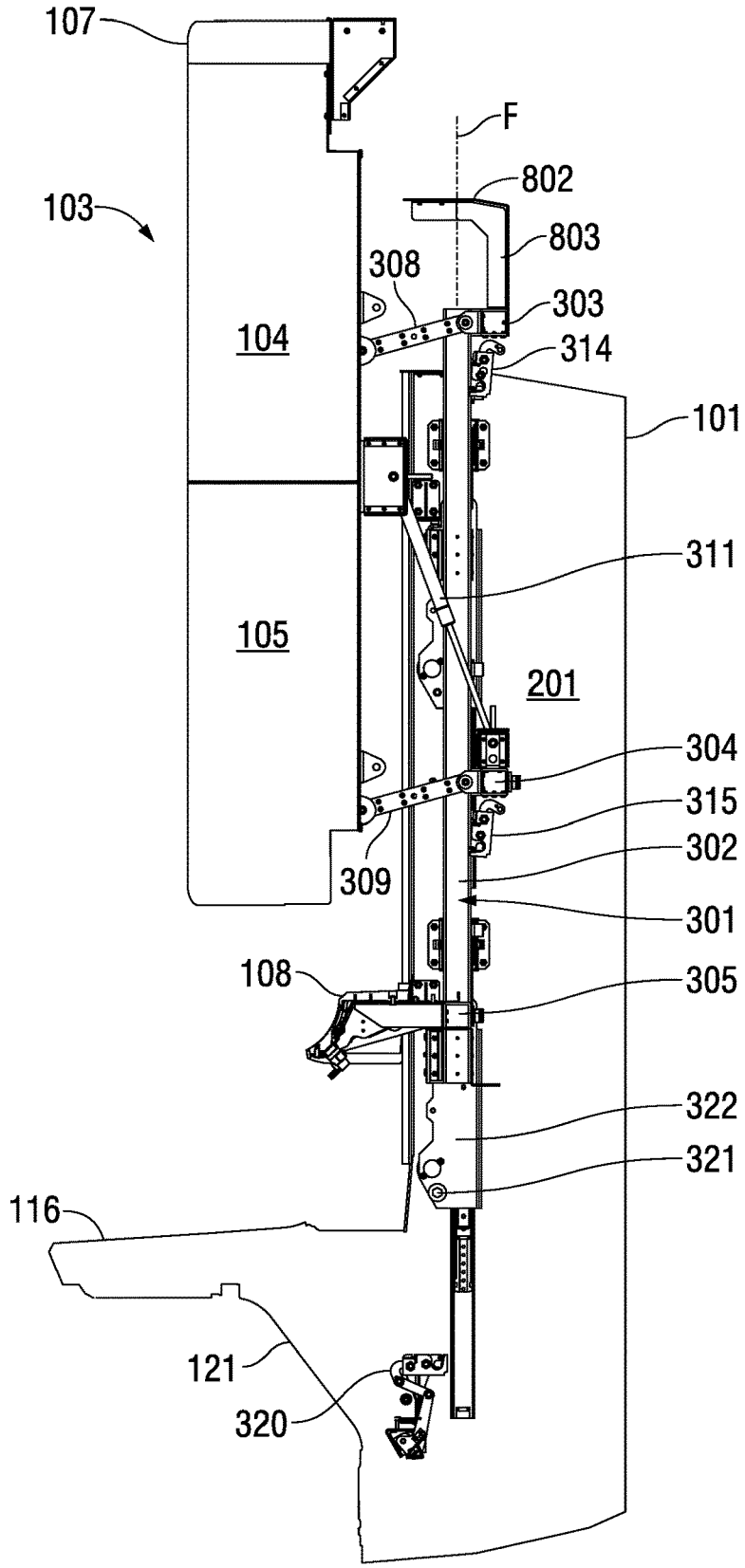
FIG. 8 is a section view similar to FIG. 7 but with the translation frame moved from the frame home position shown in FIG. 7 to the frame raised position.

Releasing the left and right side translation frame latches 320 and 420, preferably by the suitable control accessible through door 121, allows translation frame 301 to be lifted upwardly along the translation frame axis F shown in FIG. 8. Although the section view of FIG. 8 only shows the left side latch 320, it will be appreciated from the above discussion in connection with FIGS. 3 and 4 that right slide latch 420 behaves similarly to latch 320 to release translation from 301 and allow it to move upwardly along axis F under a suitable lifting force applied by appropriate personnel. The translation frame axis F in this particular embodiment corresponds with a longitudinal axis of the translation frame itself and is also approximately vertical. Movement from the translation frame home position shown in FIG. 7 to the frame raised position shown in FIG. 8 raises both component panel 108 and display assembly 103 since both the component panel and the display assembly are mounted on the translation frame 301. The biasing force provided by springs 509 and 510 shown in FIGS. 5 and springs 609 and 610 shown in FIG. 6 preferably provide sufficient force to hold translation frame 301 in the frame raised position shown in FIG. 8.

It will be noted in FIG. 8 that this particular embodiment also includes a top enclosure panel 802 mounted on translation frame 301 via a bracket 803. This enclosure panel 802 is also visible in FIG. 2 and registers with a top opening shown by boundary 805 in FIG. 2 (and in FIGS. 5 and 6). When translation frame 301 is raised from the home position shown in FIG. 7 to the raised position shown in FIG. 8, top enclosure panel 802 is raised from the top opening. This arrangement is included in the presently illustrated embodiment to allow a greater range of upward movement of translation frame 301. That upward movement would otherwise be constrained by a fixed top enclosure of the gaming machine cabinet.

Figure 9:
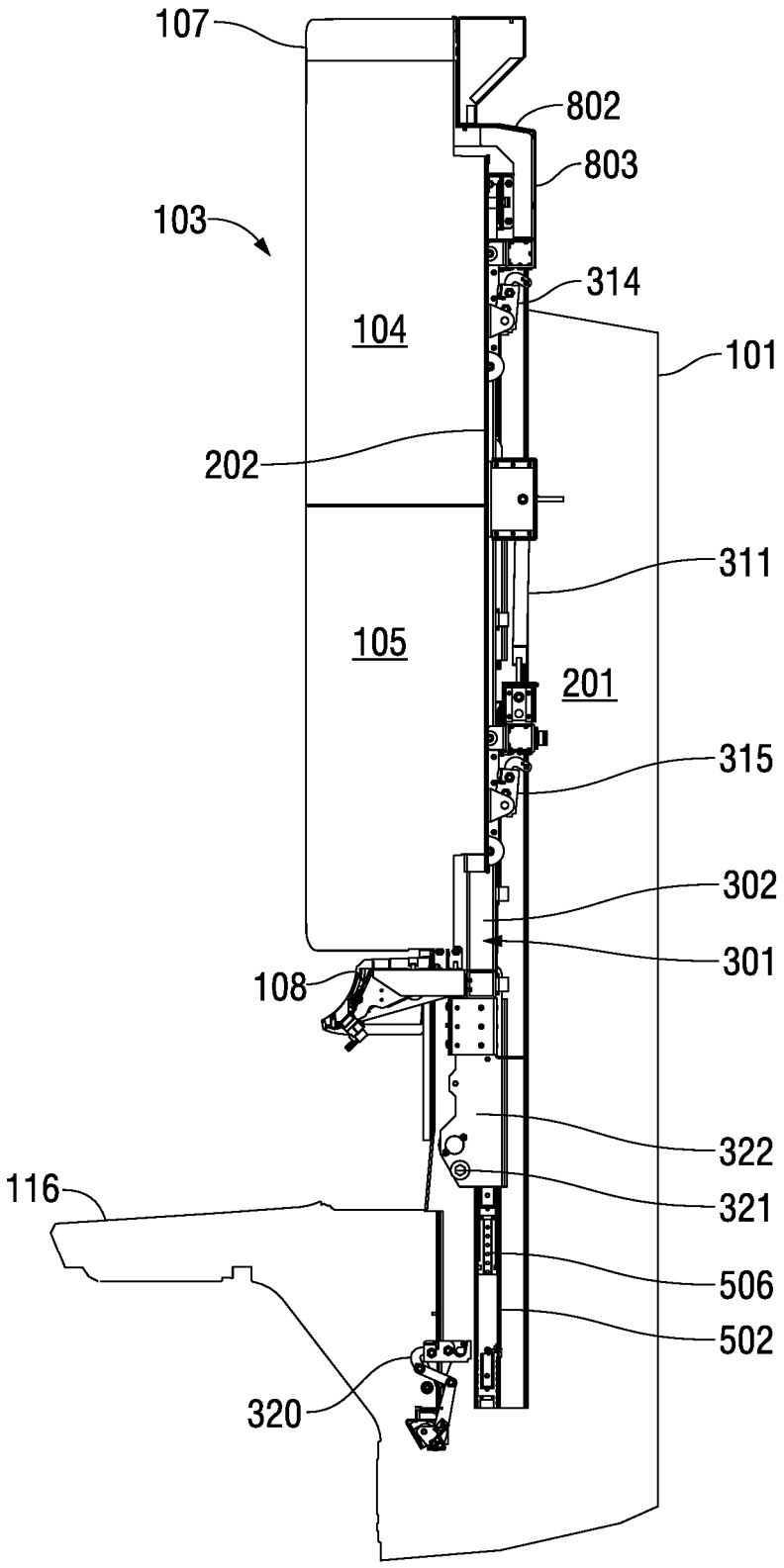
FIG. 9 is a section view similar to FIG. 8 but with the display assembly translation structure moved to the retracted position while the translation frame remains in the frame raised position.

FIG. 9 shows that the display assembly translation structure may be positioned in its retracted position while translation frame 301 is in its frame raised position. Thus it will be apparent that translation frame 301 may be moved from its frame home position to the frame raised position either with the display assembly 103 extended as shown in FIG. 8 or with the display assembly 103 retracted as shown in FIG. 9. The independent operation of the display assembly translation structure latches 314, 315, 414, and 415, and the translation frame latches 320 and 420 allow this independent operation in this particular embodiment. From the position shown in FIG. 9, an operator may apply a downward force to overcome the biasing force of springs 509, 510, 609, and 610 to return translation frame 301 from the frame raised position to the frame home position shown in FIGS. 3 and 4.

Numerous variations are possible on the example gaming machine shown in the figures. For example, although the display mounting bracket 202 is shown and described as a part separate from display assembly 103, some embodiments may include a display assembly which incorporates structure performing the function of display mounting bracket 202. Also, although two curved displays 104 and 105 and sound bar 107 are shown for the example display assembly 103, the invention is not limited to any number or type of display devices or other devices included in the display assembly. Furthermore, the positions of the slide elements 505 and 506 and 605 and 606 may be reversed with the respective rails so that the slide elements are fixed to the cabinet and the rails slide with respect to the cabinet. Also, only a single slide element and rail combination may be included on each lateral side of the cabinet to support the translation frame for its desired movement.

As used herein, whether in the above description or the following claims, the terms "comprising," "including," "carrying," "having," "containing," "involving," and the like are to be understood to be open-ended, that is, to mean including but not limited to. Also, it should be understood that the terms "about," "substantially," and like terms used herein when referring to a dimension or characteristic of a component indicate that the described dimension/characteristic is not a strict boundary or parameter and does not exclude variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Any use of ordinal terms such as "first," "second," "third," etc., in the following claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The term "each" may be used in the following claims for convenience in describing characteristics or features of multiple elements, and any such use of the term "each" is in the inclusive sense unless specifically stated otherwise. For example, if a claim defines two or more elements as "each" having a characteristic or feature, the use of the term "each" is not intended to exclude from the claim scope a situation having a third one of the elements which does not have the defined characteristic or feature.

The above described preferred embodiments are intended to illustrate the principles of the invention, but not to limit the scope of the invention. Various other embodiments and modifications to these preferred embodiments may be made by those skilled in the art without departing from the scope of the present invention. For example, in some instances, one or more features disclosed in connection with one embodiment can be used alone or in combination with one or more features of one or more other embodiments. More generally, the various features described herein may be used in any working combination.

The invention claimed is:

1. A gaming machine including:

(a) a cabinet defining a cabinet volume;

(b) a front access opening defining a front boundary of the cabinet volume;

(c) a display assembly including one or more display devices for the gaming machine;

(d) a translation frame located within the cabinet volume, the translation frame being mounted in the cabinet so as to be moveable relative to the cabinet between a frame home position and a frame raised position; and (e) a display assembly translation structure connecting the display assembly to the translation frame, the display assembly translation structure being operable to move between a retracted position and an extended position, wherein when the display assembly translation structure is in the retracted position the display assembly registers with at least a first part of the front access opening and when the display assembly translation structure is in the extended position the display assembly is separated forwardly from the front access opening by at least a cabinet access distance.

2. The gaming machine of claim 1 wherein the translation frame moves along a frame translation axis when moved between the frame home position and the frame raised position.

3. The gaming machine of claim 2 wherein the frame translation axis and a longitudinal axis of the translation frame both extend substantially vertically when the gaming machine is in an operating position.

4. The gaming machine of claim 1 wherein the translation frame is movable between the frame home position and frame raised position when the display assembly translation structure is in the retracted position.

5. The gaming machine of claim 1 wherein the translation frame is movable between the frame home position and frame raised position when the display assembly translation structure is in either one of the retracted position or the extended position.

6. The gaming machine of claim 1 wherein:

(a) a top opening defines a portion of a top boundary of the cabinet volume; and (b) a top enclosure is mounted on the translation frame, the top enclosure being configured to register with the top opening when the translation frame is in the frame home position and to separate from the top opening as the translation frame is moved from the frame home position toward the frame raised position.

7. The gaming machine of claim 1 wherein:

(a) a first side rail is mounted in the cabinet volume at a first lateral side of the cabinet volume and a second side rail is mounted in the cabinet volume at a second lateral side of the cabinet volume;

(b) a first side carriage assembly is mounted on the first side rail so as to be slidable along a longitudinal axis of the first side rail and a second side carriage assembly is mounted on the second side rail so as to be slidable along a longitudinal axis of the second side rail; and (c) a first lateral side of the translation frame is mounted on the first side carriage assembly and a second lateral side of the translation frame is mounted on the second side carriage assembly.

8. The gaming machine of claim 1 further including a component panel mounted on the translation frame, wherein when the translation frame is in the frame home position the component panel registers with a second part of the front access opening and when the translation frame is in the frame raised position the component panel is separated from a lower boundary of the front access opening by at least a panel area access distance.

9. A method of providing access to a cabinet volume of a gaming machine cabinet where the gaming machine cabinet includes a front access opening defining a front boundary of the cabinet volume, the method including:

(a) supporting a translation frame in the cabinet volume of the gaming machine cabinet so that the translation frame is movable relative to the gaming machine cabinet vertically between a frame home position and a frame raised position when the gaming machine cabinet is in an operating position;

(b) supporting a display assembly translation structure on the translation frame, the display assembly translation structure being movable between a retracted position and an extended position;

(c) supporting a display assembly of the gaming machine on the display assembly translation structure; and (d) wherein (i) when the translation frame is in the frame home position and the display assembly translation structure is in the retracted position, the display assembly registers with a first part of the front access opening, (ii) when the translation frame is in the frame raised position and the display assembly translation structure is in the retracted position, the display assembly registers with less than the first part of the front access opening, and (iii) when the display assembly translation structure is in the extended position the display assembly is separated forwardly from the front access opening by at least a cabinet access distance.

10. The method of claim 9 wherein the translation frame is movable between the frame home position and the frame raised position while the display assembly translation structure is in the retracted position.

11. The method of claim 9 wherein the translation frame is movable between the frame home position and the frame raised position while the display assembly translation structure is in the extended position.

12. The method of claim 9 wherein supporting the translation frame in the cabinet volume includes supporting the translation frame on laterally spaced apart rails and wherein the translation frame is movable vertically between the frame home position and the frame raised position by sliding along the laterally spaced apart rails.

13. The method of claim 9 further including applying a frame biasing force between the gaming machine cabinet and the translation frame so as to bias the translation frame upwardly.

14. The method of claim 13 wherein applying the frame biasing force includes applying a respective first side biasing force at two different locations on first lateral side of the translation frame and applying a respective second side biasing force at two different locations on a second lateral side of the translation frame.

15. The method of claim 9 further including supporting a component panel on the translation frame, the component panel registering with a second part of the front access opening when the translation frame is in the frame home position and separating from the second part of the front access opening when the translation frame is moved from the frame home position toward the frame raised position.

16. The method of claim 15 wherein the second part of the front access opening is below the first part of the front access opening.

17. The method of claim 9 wherein the gaming machine cabinet includes a top opening defining a portion of a top boundary of the cabinet volume and further including supporting a top enclosure on the translation frame so as to register with the top opening of the gaming machine cabinet when the translation frame is in the frame home position, the top enclosure separating from the top opening as the translation frame is moved from the frame home position toward the frame raised position.

* * * * *